US005621386A

United States Patent [19]

Huang

[11] Patent Number: 5,621,386

[45] Date of Patent: Apr. 15, 1997

[54] ELEVATED FLOOR ALARM SYSTEM

[76] Inventor: Chien-Teh Huang, No. 105, Sec. 4, Shan-Ho Road, Shan-Chung City, Taipei Hsien, Taiwan

[21] Appl. No.: 611,262

[22] Filed: Mar. 5, 1996

[51] Int. Cl.[6] ..... G08B 13/20

[52] U.S. Cl. ..... 340/544; 340/541; 340/626; 340/666

[58] Field of Search ..... 340/541, 544, 340/626, 666; 200/85 R, DIG. 35

[56] References Cited

U.S. PATENT DOCUMENTS

| | | | |
|---|---|---|---|
| 4,032,804 | 6/1977 | Wagner | 310/328 |
| 4,075,616 | 2/1978 | Rait | 340/666 |
| 4,107,660 | 8/1978 | Chleboun | 340/566 |
| 4,336,533 | 6/1982 | Wettach | 340/573 |

*Primary Examiner*—Jeffery Hofsass
*Assistant Examiner*—Mark S. Rushing
*Attorney, Agent, or Firm*—Pro-Techtor International

[57] ABSTRACT

An alarm system as a support of an elevated floor, whose plurality of pressure sensing devices are installed as a support outside the floor of the protection area, wherein a pressure sensing device comprises: a cover in direct contact with the lower side of the floor; a vessel, mounted below the cover, having a basin in its middle below the cover, to be filled with liquid, the basin of the vessel having a hole, through which the liquid can flow; a seal, inserted between the cover and said vessel along the circumference of the basin to impermeably seal the basin, said cover and said vessel being not in contact with each other to leave a gap for the cover to move down; an elastic membrane, which is mounted tightly on the vessel at the place of the opening of the hole; and a sensor, which is in contact with the elastic membrane to sense the deformation of this membrane under the pressure of said liquid; whereat, when an external weight exerts pressure on the floor, the cover, having undergone pressure, in turn presses on the liquid and further on the membrane, leading to contacting the sensor and precise detection with subsequent information to responsible personnel.

6 Claims, 7 Drawing Sheets

ELEVATED FLOOR ALARM SYSTEM

TECHNICAL FIELD

This invention relates to an alarm system below an elevated floor, supporting it, especially to a precise indoor alarm system with a liquid medium and of high sensitivity.

BACKGROUND OF THE INVENTION

Conventional alarm check systems are found in high-rise buildings, jewelers' shops, and where valuable goods or data are stored. Often a camera-like device can be seen on the ceiling. With the technological progress this kind of cameras increasingly used infrared beam recording systems to record intruders in darkness, too. On movies we often see expositions of high secrecy and value which use laser alarm systems as a safety measure, but the intruder always finds a way to escape recording and to leave the place unnoticed.

Actually, these conventional alarm systems all have blind spots and are incapable of checking all locations. With the technological progress it is no difficulty to disable or evade them. Of course, this kind of alarm check systems all have their special checking method and merit, but it cannot be denied that, in order to guard treasures, there is a need for a more efficient alarm check system.

The main objective of this invention consists in providing a precise alarm system of high sensitivity supporting an elevated floor.

A further objective of this invention consists in providing a precise alarm system supporting an elevated floor, which effectively covers the whole protection area and is hidden.

The technical methods, structural parts and their function in order to achieve these and other objectives will become clear from the following embodiments and suitable related drawings.

BEST MODE TO CARRY OUT THE INVENTION

Figure 1:
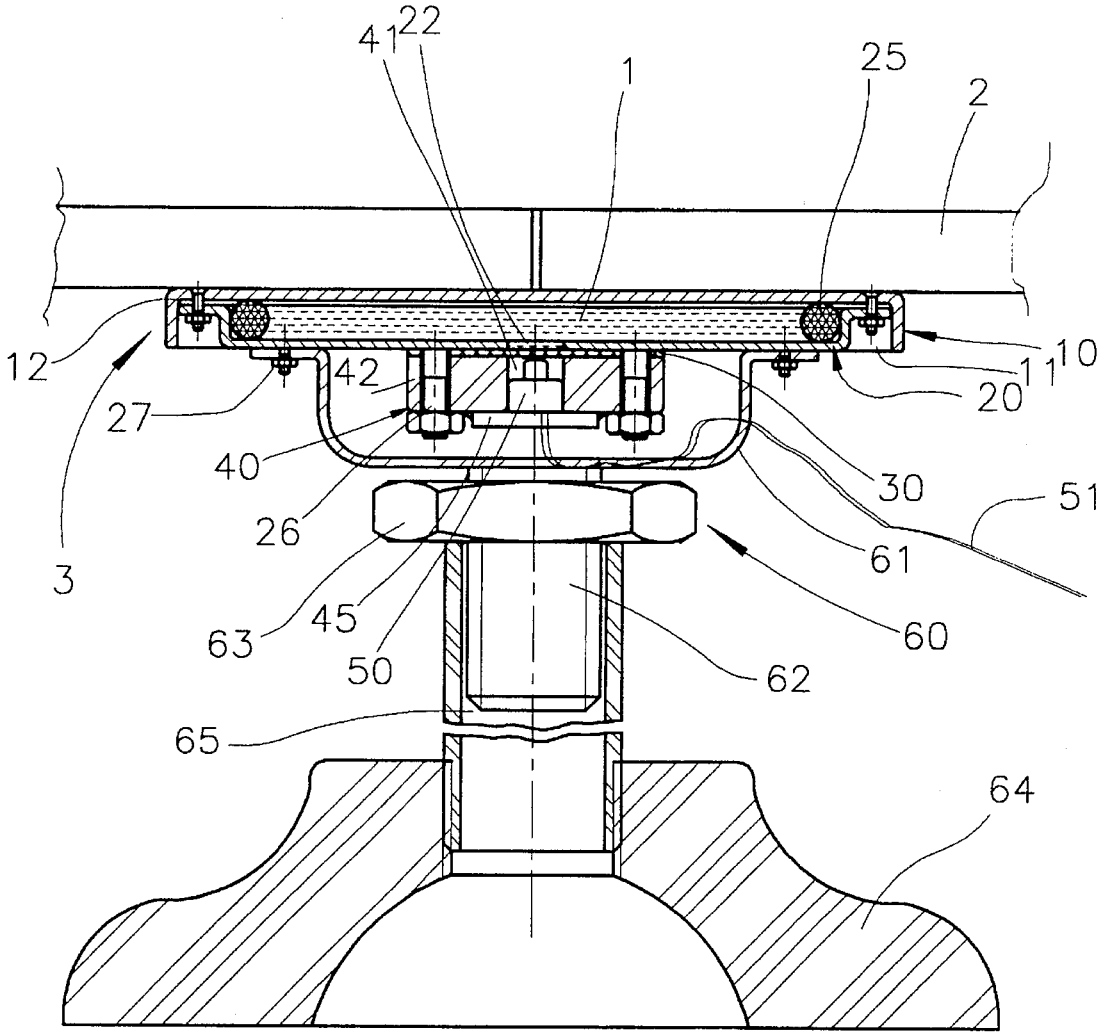
FIG. 1 is a sectional view of this invention showing the overall structure of this invention.

As shown in every figure, this invention is an alarm system supporting an elevated floor. Under the elevated floor 2, between the ground and the lower surface of the floor 2 a plurality of pressure sensing devices 3 are installed. Thus the detection range covers the whole protection area. When an intruder steps on the floor 2, the floor 2 is immediately pressed down and by contact stirs the pressure sensing devices 3. A pressure sensing device 3 is roughly made of a cover 10 and a vessel 20, which are impermeably sealed together. The vessel 20 is filled with liquid 1. Since the liquid 1 is incompressible, the change of pressure in the liquid 1, when some extra weight presses on the cover 10, can be readily employed to stir a sensor 50 and send the generated signal through the signal line 51 to resposible personnel.

Figure 2:
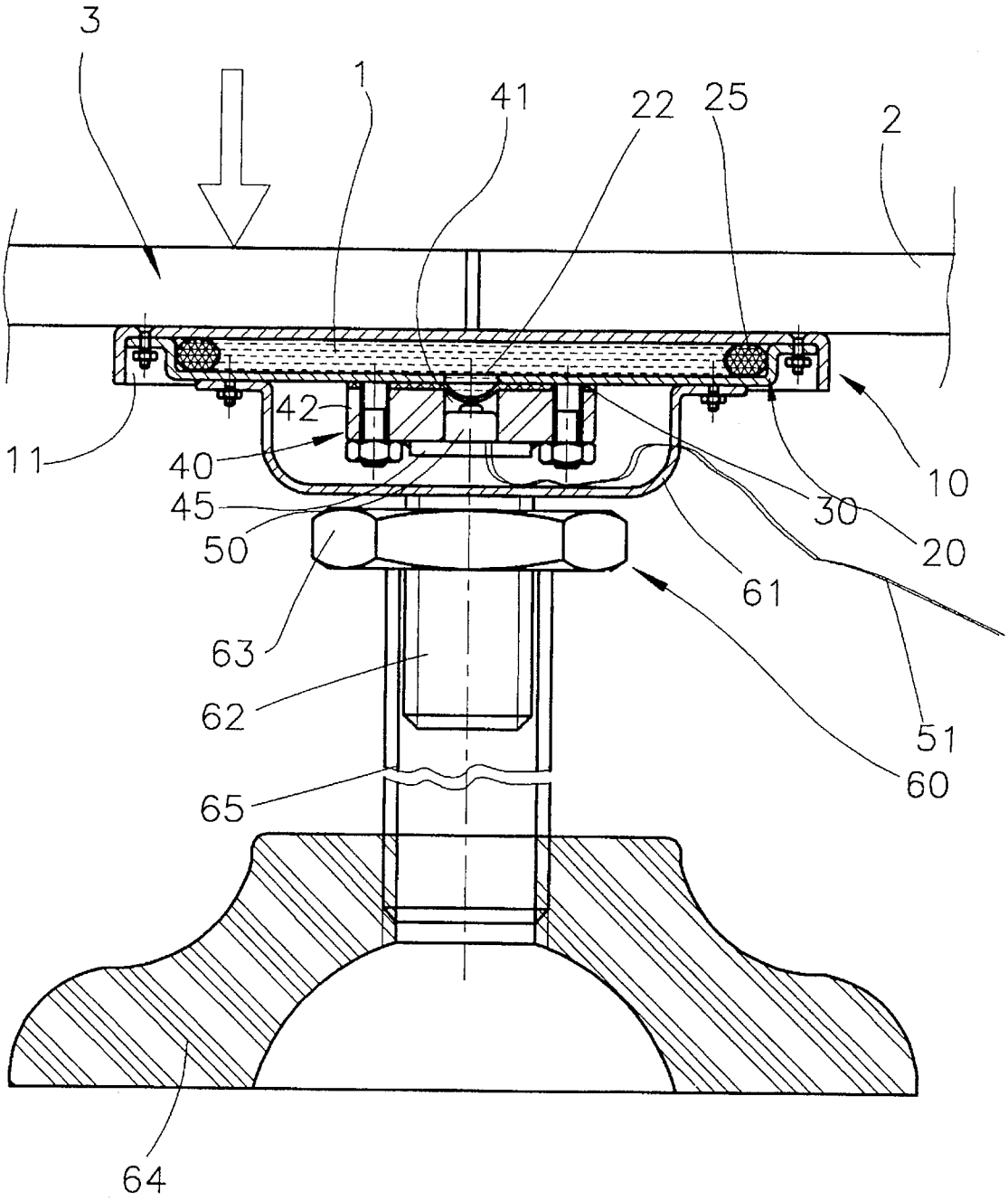
FIG. 2 is a sectional view of this invention showing the change in the structure of this invention, when an intruding object has been detected.
Figure 3:
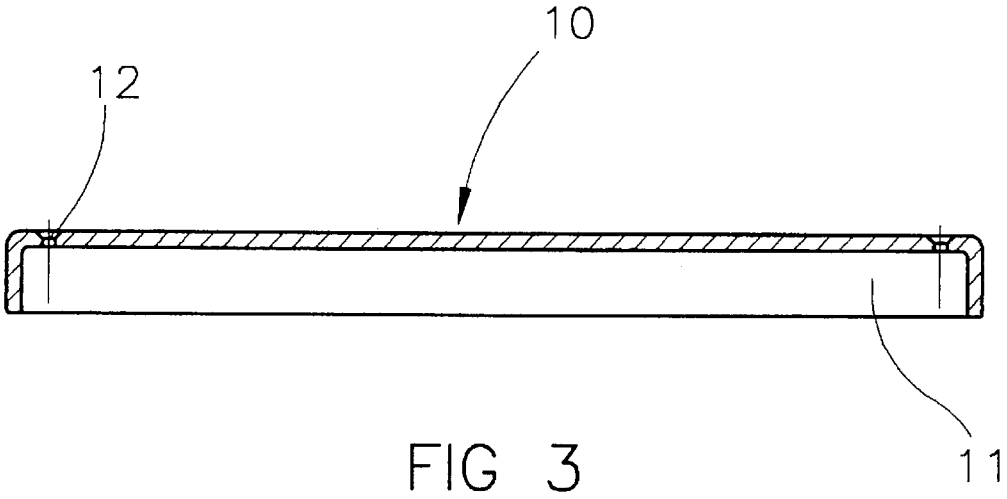
FIG. 3 is a sectional view of the cover of this invention.

As shown in FIG. 1, 2 and 3, the cover 10 is in direct contact with the lower side of the floor 2. The edge of the cover 10 is bent downwards as a rim 11.

Figure 4:
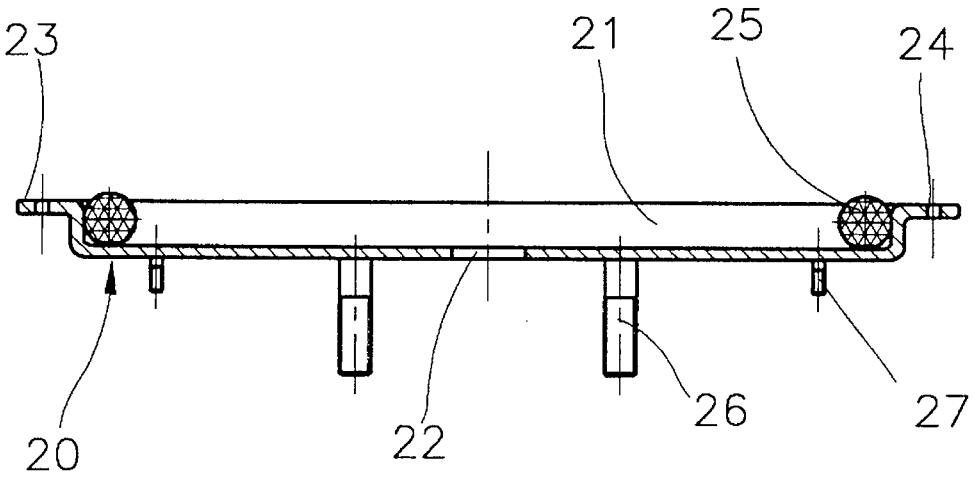
FIG. 4 is a sectional view of the vessel of this invention.
Figure 5:
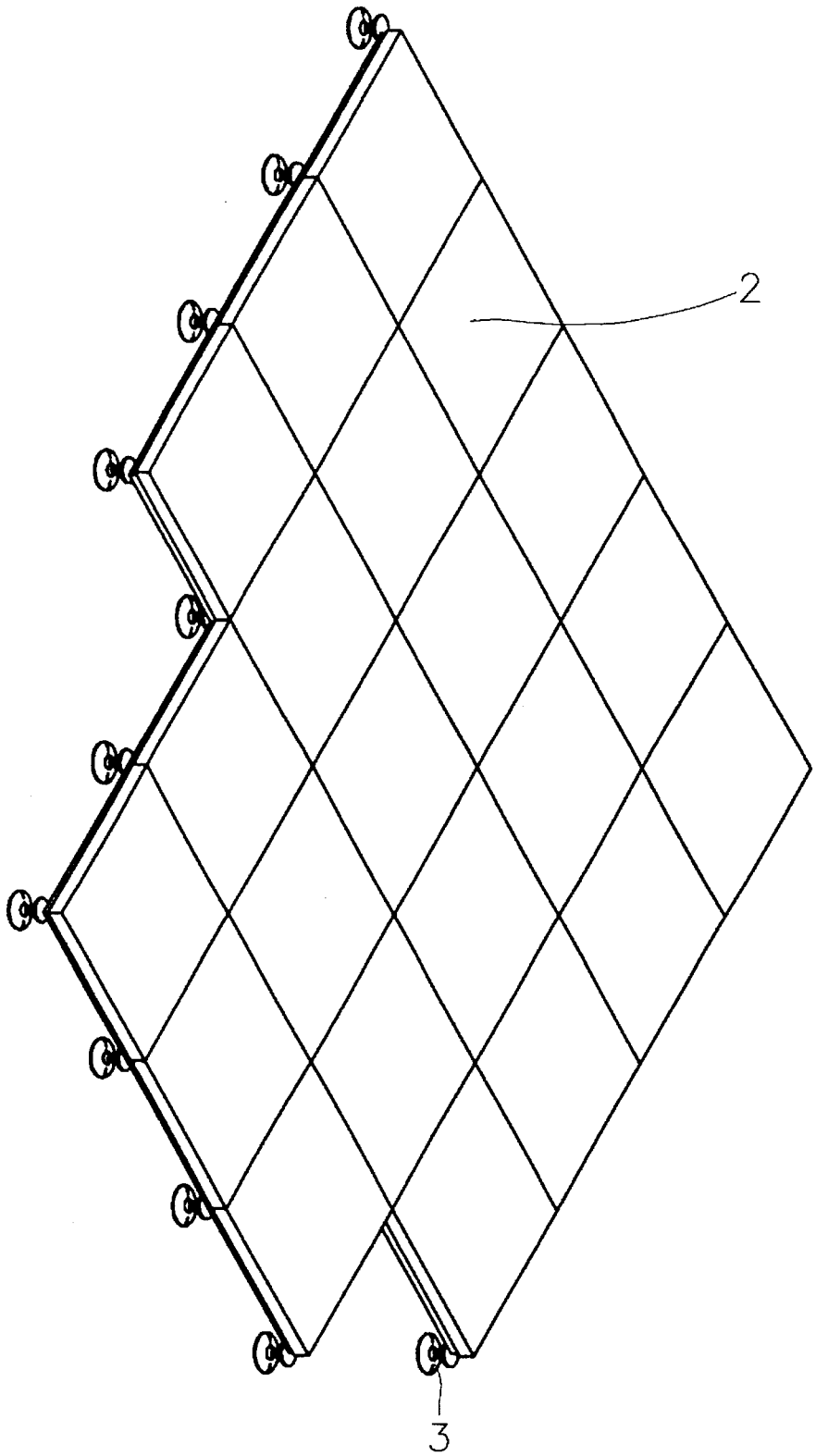
FIG. 5 is a three-dimensional schematic illustration of this invention showing the installation of the pressure sensing alarm system.

As shown in FIG. 1, 2 and 4, the central part of the vessel 20 is provided with a basin 21 vaulting downwards to be filled by the liquid 1. The bottom surface of the basin 21 is provided with a hole 22, through which the liquid 1 in the basin 21 can flow out. Between the cover 10 and the vessel 20 a seal 25 is inserted, the thickness of which is larger than the depth of the basin 21. It is laid in along the cicumference of the basin 21, such that after screwing the cover 10 and the vessel 20 together no liquid 1 will leak out of the basin 21.

On the top of the basin 21 a rim 23 extends outwards, which is surrounded by the downward extending rim 11 of the cover 10. The flat surface of the rim 23 is provided with several holes 24, and the cover 10 is provided with several holes 12, coinciding with the holes 24, such that any bolts passing through the holes 24 simultaneously pass through the holes 12, in order to fasten together the cover 10 and the vessel 20. When the cover 10 and the vessel 20 are fastened together, a gap is left between the rim 23 and the bottom surface of the cover 10, so the cover 10 and the vessel can move up and down against each other.

Since the thickness of the seal 25 is larger than the depth of the basin 21, the contact area between the seal 25 and the cover 10 is impermeable, although the cover 10 and the vessel 20 are fastened together without touching each other. The seal 25 is made of elastic material, so, when the cover 10 is exposed to external weight, it can move down. After removing the weight the cover 10 will by the elastic force of the seal 25 return to its original position.

The bottom of the outside of the basin 21 close to the middle is provided with several bolts 26, which extend vertically downwards from the bottom surface of the basin 21. They surround the hole 22 in a circle. They serve to connect to the support The support 40 is roughly a block. In the middle of the support 40 there is an accommodating hole 41, whose position coincides with the position of the hole 22. It extends vertically downwards from the top side of the support 40 and accommodates the sensor 50. A support plate 45 is fixed on the bottom side of the accommodating hole 41 providing a stable mount of the sensor 50 inside the accommodating hole 41. The signal line 51 of the sensor 50 passes through the support plate 45, connecting to the outside world. By means of the signal line 51 the sensor 50 can be electrically connected to an alarm system installation. The support 40 is further provided with several holes 42 close to its circumference. The holes 42 and the bolts 26 concide with each other, such that the support 40 can be fastened to the vessel 20.

Between the support 40 and the vessel 20 a flexible membrane 30 is inserted. The flexible membrane 30 covers the lower exit of the hole 22 and seals it. When the cover 10 is exposed to the pressure of an external weight, moving down and leading to a decrease of the sealed volume above the basin 21 of the vessel 20, then the liquid 1 in the basin 21 undergoes pressure. So it presses in turn through the hole 22 onto the flexible membrane 30 and deforms the flexible membrane 30. At the same time the sensor 50 is stirred and sends out an alarm signal.

Since the diameter of the basin 21 is much larger than the diameter of the hole 22, the flexible membrane deforms by a large amplitude, when the sealed volume above the basin 21 decreases. This magnifying effect leads to a high sensitivity of the pressure sensing device 3 and allows for precise detection of an intruder's action.

Since the pressure sensing device 3 is mounted below the floor 2, it is hidden. Several pressure sensing devices 3 mounted below the floor 2 lead to a detection range covering the whole protection area, leaving no chance for an intruder to escape.

Furthermore, the bottom of the basin 21 rests on a stand 60, fixed by a plurality of bolts 27.

The stand 60 comprises: a hull body 61, fastened to the bottom of the vessel 20; a threaded bolt 62, extending downwards from the bottom of the hull body 61; a female screw 63, surrounding the threaded bolt 62 and engaging with it; and a foot 64, which the threaded bolt 62 is sticked into, while the female screw 63 can rest on the foot 64 to adjust the height of the threaded bolt 62 in relation to the foot 64.

The lower parts of the foot 64 are comparatively large, and in the middle of the foot 64 there is an insertion hole 65, into which the threaded bolt 62 is inserted. At the same time, the female screw 63 rests on the upper end of the insertion hole 65 of the foot 64. Thus the pressure sensing device 3 is stably supported. The height of the pressure sensing device 3 is adjustable by turning the female screw 3, and the floor 2 stays horizontal.

Figure 6:
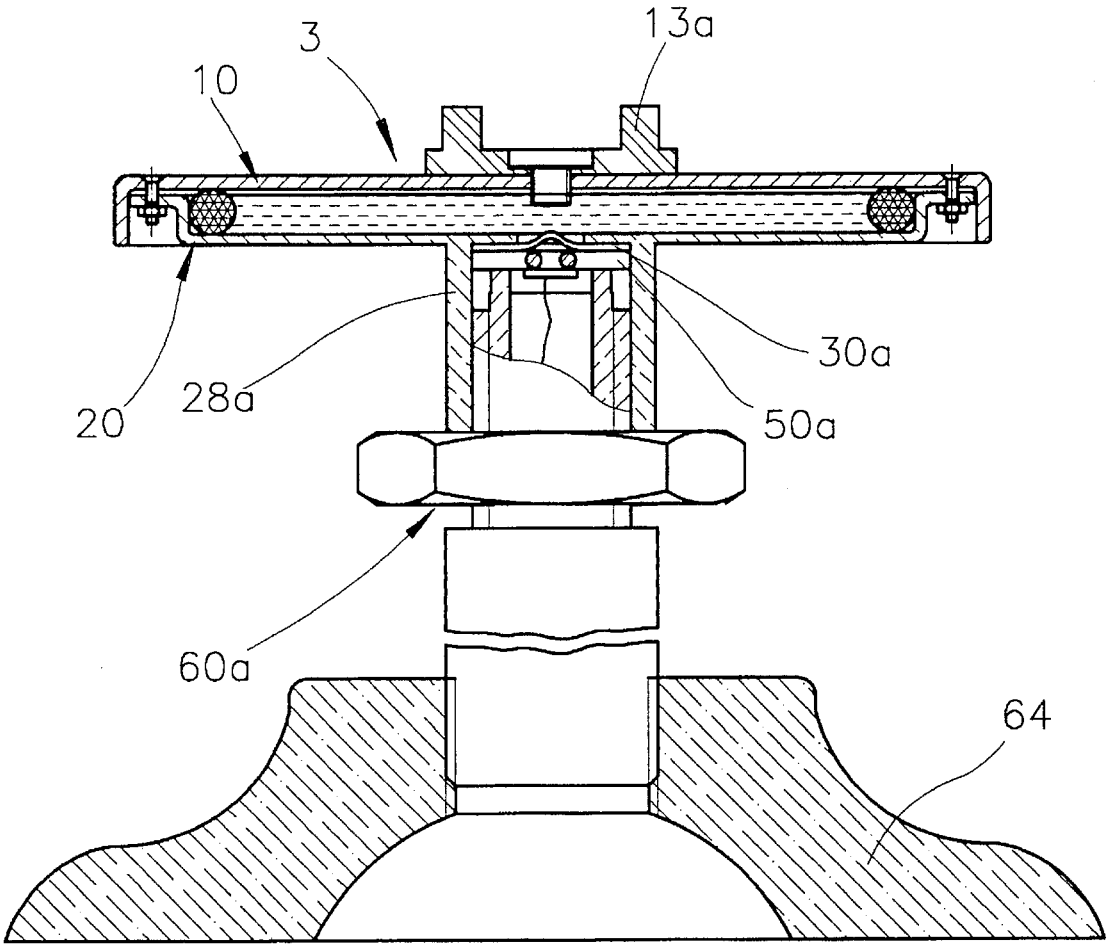
FIG. 6 is a sectional view of another embodiment of this invention showing the substituted structural parts.

As shown in FIG. 6, in another embodiment of this invention's pressure sensing device, the cover 10 is provided with an upper support 13*a*, which will block the floor 2 from moving on its upper side.

From the bottom of the basin 21 of the vessel 20 a tube 28*a* extends vertically downwards, surrounding the perimeter of the hole 22 in the vessel 20. The inner surface of the tube 28*a* is threaded. The tube 28*a* is used to mount a sensor 50*a* in it. It can be linked to a stand 60*a*. So the sensor 50*a* can be installed inside the tube 28*a*, fitting the opening of the hole 22 in the vessel 20, and is pressed on by the stand 60*a*.

Between the sensor 50*a* and the vessel 20 an electrically conducting flexible membrane 30*a* can be inserted. The electrically Conducting flexible membrane 30*a* is attached at the lower opening of the hole 22. It protrudes upwards into the opening of the hole 22, such that it is not in direct contact with the sensing tip of the sensor 50*a*, and it seals the hole 22. When the cover 10 is exposed to the pressure of an external weight and moves downwards, the liquid 1 in the basin 21 presses through the hole 22 down on the upward protruding part of the flexible membrane 30*a*, and the sensor 50*a*, being in contact with the flexible membrane 30*a*, issues an alarm signal.

The stand 60*a* is roughly a threaded bolt. It is used to link to the tube 28*a* and to hold the sensor 50*a*. At the same time it is linked to the foot 64 to provide a stable support for the pressure sensing device 3.

Figure 7:
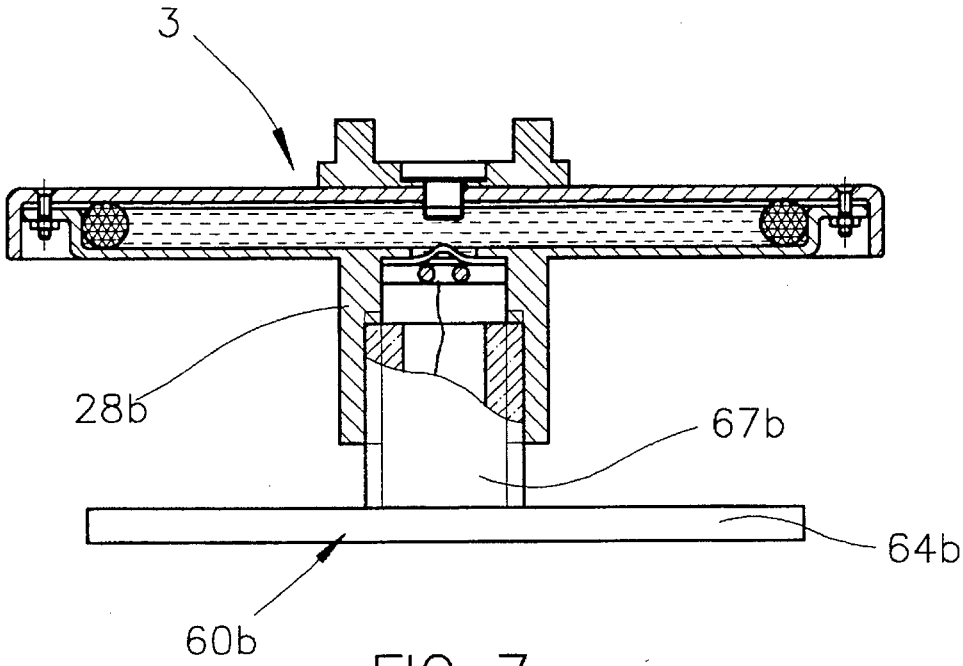
FIG. 7 is a sectional view of yet another embodiment of this invention showing the substituted structural parts.

As shown in FIG. 7, in the third embodiment of this invention's pressure sensing device, a tube 28*b* is installed, as in the embodiment above, which is directly connected to a stand 60*b*.

The stand 60*b* is provided with a foot 64*b*, which has a lower part with a comparatively large diameter and in the middle of which an upward extending threaded bolt 67*b* is provided. The threaded bolt 67*b* engages with the tube 28*b*, providing a stable support for the pressure sensing device 3. At the same time the height of the pressure sensing device 3 is adjustable by turning the threaded bolt 67*b*.

Figure 8:
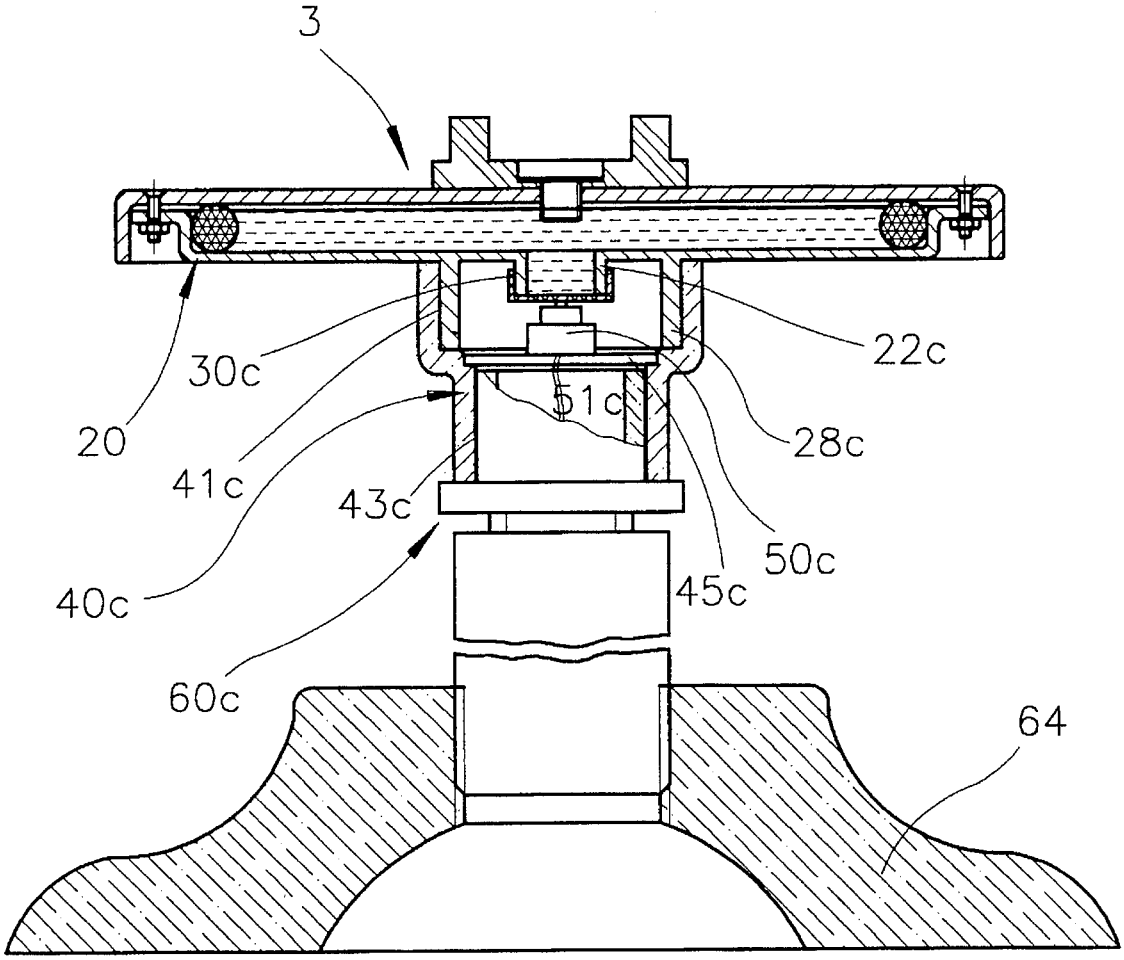
FIG. 8 is a sectional view of yet another embodiment of this invention showing the substituted structural parts.

As shown in FIG. 8, in the fourth embodiment of this invention's pressure sensing device, a rim 22*c* on the circumference of the hole 22 of the vessel 20 extends vertically downwards. A flexible membrane is put over the rim 22*c*, sealing the opening of the hole 22. When the liquid 1 in the basin 21 is exposed to pressure, it presses in turn on the flexible membrane 30*c* without leaking. On the lower side of the flexible membrane 30*c* a sensor 50*c* is fixed, fitting the opening of the hole 22. It is used to sense the deformation of the flexible membrane caused by the liquid 1.

The basin 21 of the vessel 20 is on its lower side provided with a tube 28*c*, which extends vertically downwards and surrounds the perimeter of the rim 22*c*. It is used to link to a support 40*c*.

The support 40*c* is roughly a tubular body. It has an accommodating hole 41*c*, which extends from the top side of the support 40*c* a certain range vertically downwards along the axis of the bore. A mounting plate 45*c* is inserted into the accommodating hole 41*c*. The sensor 50*c* is attached to the mounting plate 45*c*, and the signal line 51*c* passes through the mounting plate 45*c*, linking to the outside world.

The lower part of the support 40*c* has a hole 43*c*, which extends from the bottom side of the support 40*c* a certain range vertically upwards along the axis of the bore. It is used to link to a stand 60*c*. The stand 60*c* is linked to the foot 64 in the same way as the stand 60*a* and provides a stable support for the pressure sensing device 3.

Figure 9:
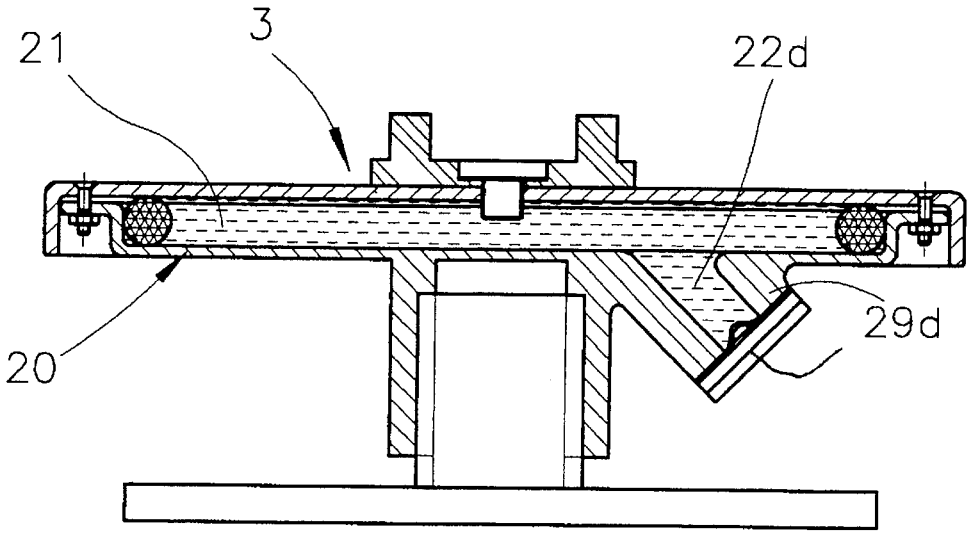
FIG. 9 is a sectional view of the fifth embodiment of this invention showing the substituted structural parts.

As shown in FIG. 9, in the fifth embodiment of this invention's pressure sensing device, the sensor part of the pressure sensing device 3 is located on a different place to let the pressure sensing device's signal easier link to the outside world.

In this embodiment, the basin 21 of the vessel 20 has a hole 22*d* on its bottom side, which is located away from the center of the basin 21 and whose axis is slanted downwards and outwards. On the circumference of the hole 22*d* there is a rim 29*d*, linked to the flexible membrane the sensor and the mounting plate, such that the signal can be easily taken from outside and easy maintenance is achieved.

Figure 10:
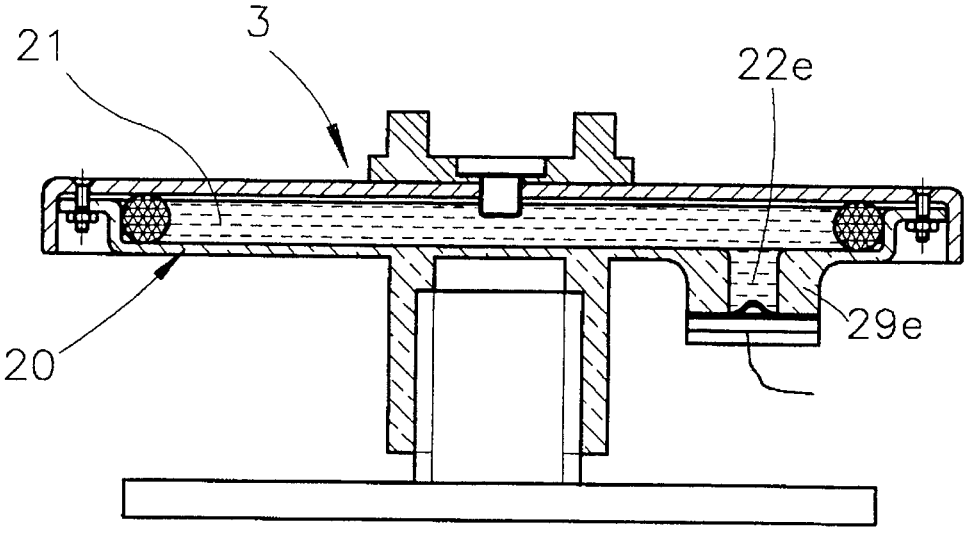
FIG. 10 is a sectional view of the sixth embodiment of this invention showing the substituted structural parts.

As shown in FIG. 10, in the sixth embodiment of this invention's pressure sensing device, the basin 21, like in the fifth embodiment, has a hole 22*e* on its bottom side, which is located away from the center of the basin 21 and whose axis points vertically downwards. On the circumference of the hole 22*e* there is a rim 29*e*, linked to the flexible membran, the sensor and the mounting plate, such that the signal can be easily taken from outside.

What is claimed is:

1. An elevated floor alarm system, comprising:

a floor, which is elevated over the ground at the location of the alarm;

a plurality of pressure sensing devices, installed between said floor and the ground, further comprising:

liquid as a detecting medium;

a cover, which is in contact with the lower side of said floor;

a vessel, mounted below said cover, having a basin in its middle below said cover, forming a cavity with said cover, to be filled with said liquid; and a hole in the lower part of said basin of said vessel, allowing said liquid to flow into said hole;

a seal, inserted between said cover and said vessel along the circumference of said basin to impermeably seal said basin, the thickness of said seal being larger than the depth of the basin, such that said cover and said vessel are not in contact with each other to leave a gap for said cover to move down;

an elastic membrane, which is mounted tightly on said vessel at the place of the opening of said hole, and which, when said cover is exposed to an external weight and moves down, is deformed by the pressure of said liquid via said hole, and when the external weight is relieved and said cover returns to its original position, also returns to its original state;

a sensor, which is installed below the lower side of said elastic membrane to sense the deformation of said membrane under the pressure of said liquid; and a stand between said pressure sensing device and the ground, providing support for said pressure sensing device;

whereat, when an external weight exerts pressure on said floor, said cover, having undergone pressure, in turn presses on said liquid and further on said membrane, thus stirring said sensor and leading to precise detection with subsequent information to responsible personnel for further dealing.

2. An elevated floor alarm system, as claimed in claim 1, wherein said cover is provided with an upper support on its upper side to block said floor from any movement.

3. An elevated floor alarm system, as claimed in claim 1, wherein said stand further comprises:

a hull body, mountable on the lower part of said vessel to carry said pressure sensing device;

a threaded bolt, extending downwards from the bottom of said hull body, with a female screw surrounding said threaded belt and engaging with a foot, into which said threaded bolt is insertable, as a stable support of the overall weight.

4. A pressure sensing device for detecting weight, comprising:

liquid as a detecting medium;

a cover, directly carrying the plate undergoing external weight;

a vessel, mounted below said cover, having a basin in its middle below said cover, to be filled with said liquid; and a hole in the lower part of said basin of said vessel, allowing said liquid to flow into said hole;

a seal, inserted between said cover and said vessel along the circumference of said basin to impermeably seal said basin, the thickness of said seal being larger than the depth of the basin, such that said cover and said vessel are not in contact with each other to leave a gap for said cover to move down;

an elastic membrane, which is mounted tightly on said vessel at the place of the opening of said hole, and which, when said cover is exposed to an external weight and moves down, is deformed by the pressure of said liquid via said hole, and when the external weight is relieved and said cover returns to its original position, also returns to its original state;

a sensor, which is installed below the lower side of said elastic membrane to sense the deformation of said membrane under the pressure of said liquid; and a stand between said pressure sensing device and the ground, providing support for said pressure sensing device;

whereat, when an external weight exerts pressure on said floor, said cover, having undergone pressure, in turn presses on said liquid and further on said membrane, thus stirring said sensor and leading to precise detection with subsequent information to responsible personnel.

5. A pressure sensing device, as claimed in claim 4, wherein said cover is provided with an additional upper support on its upper side.

6. A pressure sensing device, as claimed in claim 4, wherein said hole of said vessel lies outside the middle of said basin.

* * * * *